US005487718A

United States Patent [19]

Staniszewski

[11] Patent Number: 5,487,718

[45] Date of Patent: Jan. 30, 1996

[54] FOLDER FOR SHEET PAPER SUCH AS LETTER-MAIL, FLIERS AND THE LIKE

[75] Inventor: Tadeusz Staniszewski, Budd Lake, N.J.

[73] Assignee: Shap, Inc., Demarest, N.J.

[21] Appl. No.: 202,373

[22] Filed: Feb. 25, 1994

[51] Int. Cl.[6] ..... B65H 45/14

[52] U.S. Cl. ..... 493/421

[58] Field of Search ..... 493/419, 420, 493/421, 460

[56] References Cited

U.S. PATENT DOCUMENTS 4,573,672 3/1986 Lehmann ..... 493/420

4,842,574 6/1989 Noble ..... 493/421

5,076,556 12/1991 Mandel ..... 493/421

5,147,275 9/1992 Staniszewski ..... 493/419

*Primary Examiner*—Jack W. Lavinder

*Attorney, Agent, or Firm*—Bernard J. Murphy

[57] ABSTRACT

A housing, having therein only one, driven, rotatable drum, receives sheet paper for in-folding or Z-folding, selectively. Abutments, within the housing, delimit travel of the leading edge of the paper, causing the paper to buckle, there behind, and form a nip or fold; the latter is directed between the drum and a guide to one of the abutments, causing the paper to fold again. Then the fully folded paper is discharged from the housing. One of the abutments is retractable, to accommodate a Z-fold, or extendable to enable an in-fold.

14 Claims, 3 Drawing Sheets

10a
12a
18
20
22
24a
26
28
30
32
38a
40a
42
44
46
48a
50
50a
51
52
54
56
58
60
"F"

51
44
48a
50a
56
"F"
58
60
38a
26
28
30
40a
10a
12a
54

FOLDER FOR SHEET PAPER SUCH AS LETTER-MAIL, FLIERS AND THE LIKE

This invention pertains to devices for folding sheet paper, for subsequent insertion thereof into envelopes, such sheet-paper being, by way of example, letter-mail, advertising fliers, and the like, and in particular to a novel folder of greatly simplified structure and inexpensive manufacture.

Sheet paper folders are well known in the prior art, and exemplary thereof are the Paper Sheet Folding Device set out in U.S. Pat. No. 4,647,029 which was issued to Masami Ohmori on Mar. 3rd, 1987; U.S. Pat. No. 4,717,134, issued to Noriyoshi Iida, et al, for a Sheet Folding Apparatus, on Jan.5th, 1988; the U.S. Pat. No. 4,573,672, issued on Mar. 4th, 1986, to Werner Lehmann, et al, for a Paper Folding Machine; and U.S. Pat. No. 3,901,501 granted to Hermann F. Kistner, on Aug. 26th, 1975, for a Device for Making a Thrice Parallel Folded Sheet in which the Open Bent Covers ate Directed Towards the Middle.

The merits of these prior, patented devices notwithstanding, each thereof requires a plurality of rotatable, sheet-engaging rollers or drums. This circumstance, necessarily, complicates the overall structure of the device, causes a considerable expense in the manufacture thereof, and rather insures that maintenance and parts-replacement will be unduly involved.

What has long been needed is a very simplified structure, in a sheet paper folder, to minimize the expense of manufacture, and assures that servicing thereof can be facile. Especially, there has been an unmet need for an efficient, and simplified folder which requires only one, rotatable, sheet-engaging element.

In view of the foregoing, it is an object of this invention to set forth a folder, for sheet paper, of simple structure and warranting only one, rotatable, sheet engaging element, to meet the aforesaid need.

Particularly, it is an object of this invention to disclose a folder, for sheet paper such as letter-mail, fliers, and the like, comprising a housing; only one, rotatable, sheet-engaging element journalled in said housing; means confined within said housing for driving said element in rotation; a guide, mounted within said housing in juxtaposition with said element; first access means for admitting sheet paper into said housing; second access means for discharging folded sheet paper from said housing; and abutment means, within said housing, for (a) engagement thereof by a leading end of the sheet paper, and (b) engagement thereof by a first fold of the sheet paper.

Further objects of this invention, as well as the novel features thereof, will be apparent from the flowing description, taken in conjunction with the accompanying figures, in which.

Figure 1:
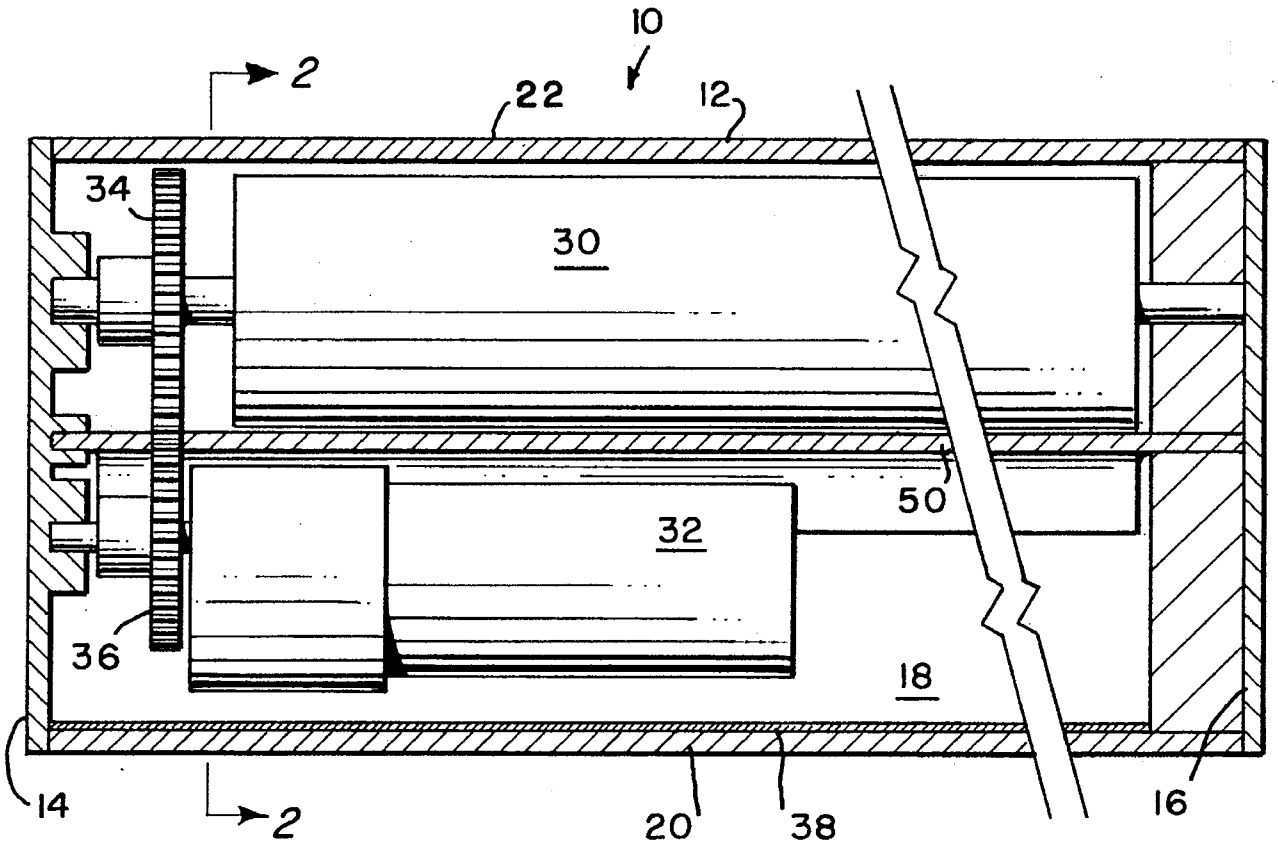
FIG. 1 is a plan view of the novel folder, according to an embodiment of the invention, with top of the housing omitted in order to enable the viewing of the housing-confined components.
Figure 2:
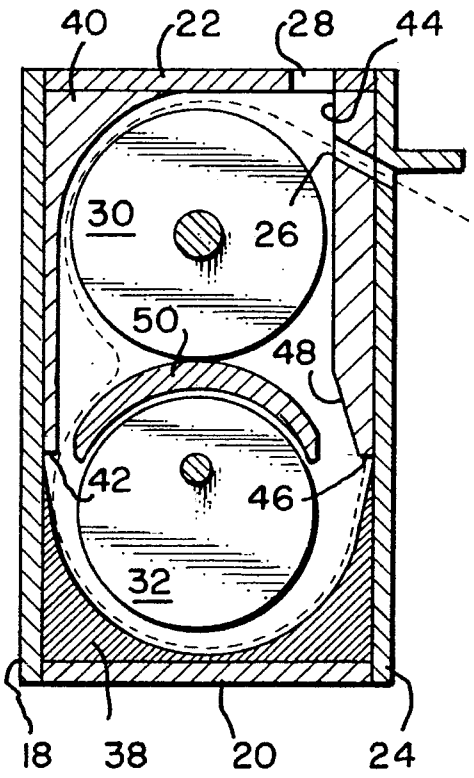
FIG. 2 is a cross-sectional view taken along section 2—2 of FIG. 1.
Figures 3, 4, 5:
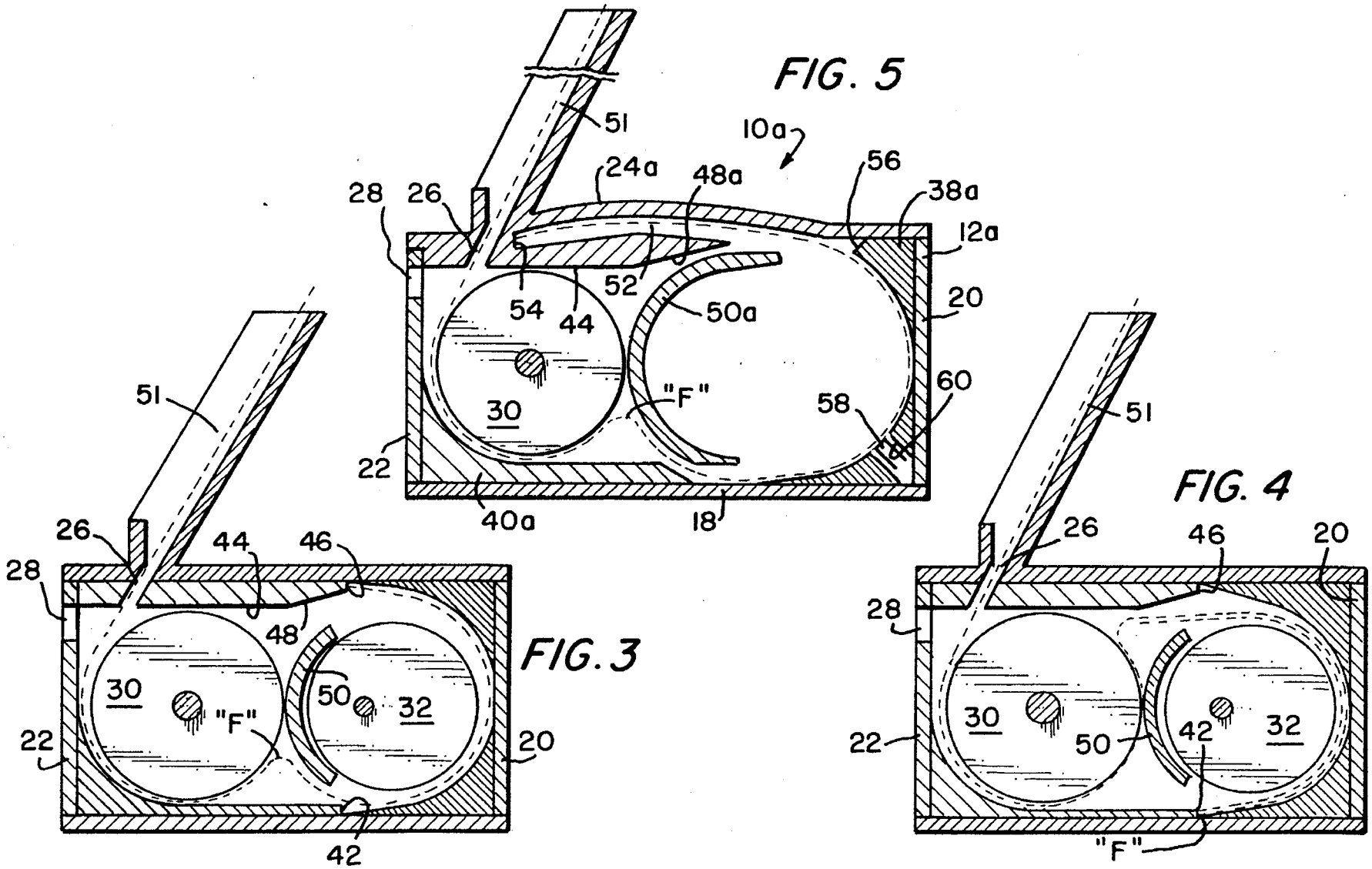

FIG. 3 is a view similar to that of FIG. 2, albeit rotated ninety degrees to depict the folder in its not normal attitude, showing sheet paper in an initial handling thereof by the folder; and FIG. 4 is a view like that of FIG. 3 showing the sheet paper once folded and just prior to, its discharge from the folder with a second fold. These illustrations, FIG. 1 through 4, depict the embodiment of the novel folder which yields up an in-folded sheet of paper (i .e., in which one of the ends of the sheet is folded into, or confined within, one of the folds of the paper).

Figures 6, 7, 8:
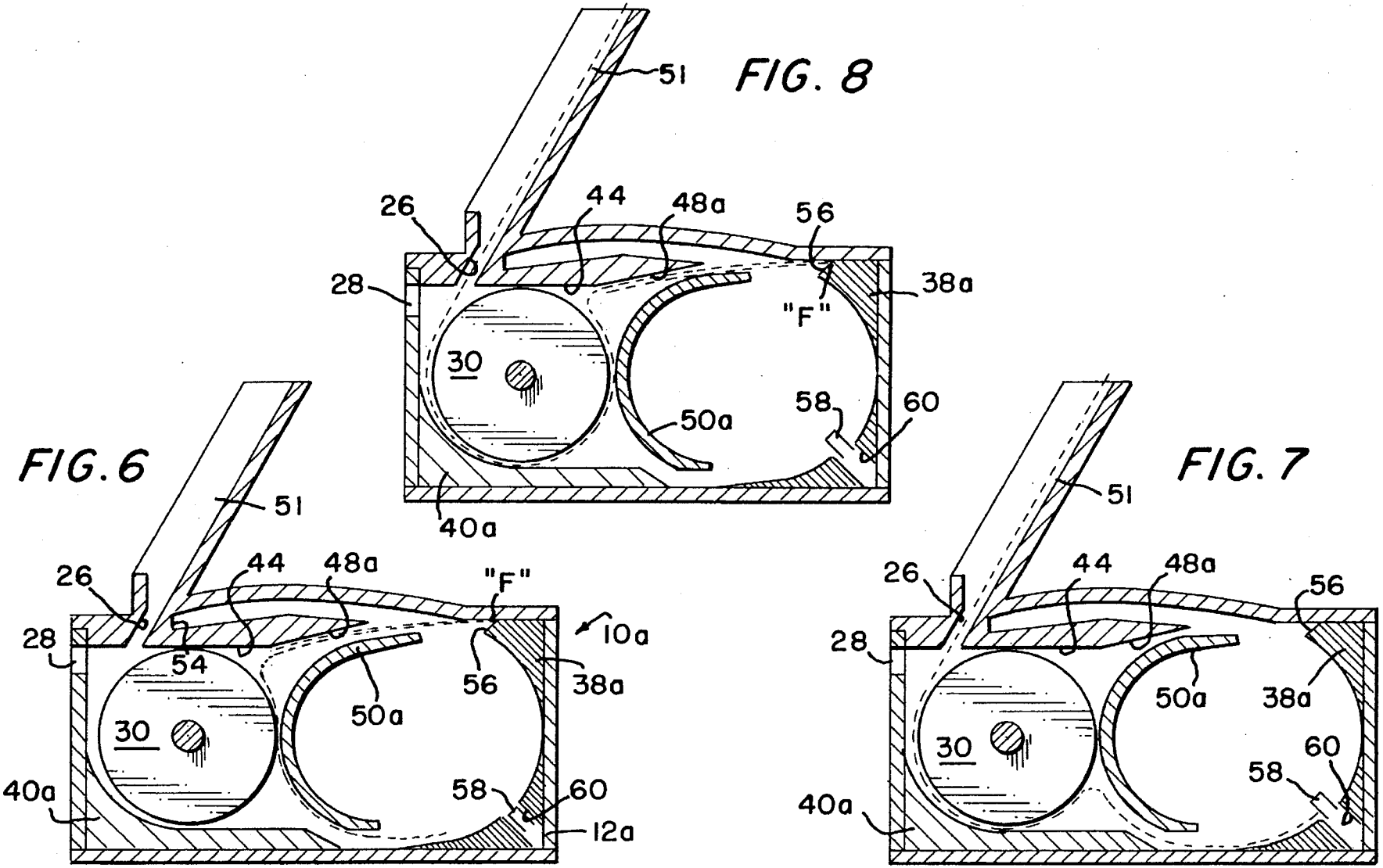

FIG. 5 is a view similar to that of FIGS. 2 through 4 of an alternative embodiment of the invention, viz., an embodiment in which the sheet paper is discharged with a L-fold (i.e., in which each end of the paper is unconfined) therein; sheet paper is shown as initially handled by the folder;

FIG. 6 shows the alternative embodiment, and depicts the sheet paper just prior to its discharge from the folder with a second fold; and FIGS. 7 and 8 show the second embodiment of the inventive folder in progressive sheet paper handling situations, illustrative of how this embodiment can be employed to change the folding from the Z-fold to the in-fold.

As shown in the figures, the novel folder 10 comprises a housing 12 having imperforate end walls 14 and 16, an imperforate bottom 18, sides 20 and 22, and a top 24. The top 24 has a sheet paper access slot 26 formed therein, and side 22 has a sheet paper access slot 28 formed therein. Slot 26 provides for the infeeding of the sheet paper, and slot 28 offers a discharge for the folded paper.

A cylindrical drum 30 is journalled in the housing 12. It is rotatably driven by an electric motor 32, mounted in the housing, through gears 34 and 36 fixed to shafts of the drum 30 and motor 32. Fixed to side 20, and between bottom 18 and top 24, is an arcuately formed insert 38. Too, fixed to bottom 18, and set against side 22 is another arcuately formed insert 40. The innermost end 42 of insert 40 defines an abutment having a purpose which is explained in the ensuing text. Also, fixed to the top 24 is a land 44; the innermost end of land 44 defines another abutment 46, and contiguous with abutment 46 is a sloped ramp 48. The purposes of abutment 46 and ramp 48 are also explained subsequently. Mounted within the housing 12, between the top 24 and the bottom 18, with an intermediate portion thereof in proximate adjacency to the drum 30, is an arcuate guide 50. Means not shown power the motor 32.

FIGS. 3 and 4 show the folder 10 in its normal attitude for use, and with reference thereto, the operation thereof is now explained. A trackway 51 is mounted to the top 24, and externally thereof, for properly orienting sheet paper for admittance into the housing via the slot 26. With the drum rotatably powered, the leading end of the sheet paper is drawn into the housing 12, along insert 40, across the bottom 18, and is curved along insert 38 until the leading edge thereof contacts the abutment 46. Due to the relative stiffness of the sheet paper, and the fact that free entry thereof is now stopped by abutment 46, the sheet paper proceeds to buckle in a relatively free space above the bottom, midway between the guide 50 and the drum 30. Continuous, drum in-feeding of the sheet paper causes the buckled portion to rise between the drum 30 and the guide 50 where it is forced into a fold—a first fold, "F". The fold "F" is drawn up through the near-mating of the guide 50 and drum 30, pulling the first length of the sheet paper, which initially was disposed against the insert 38, therewith. The nose of the fold "F" engages the ramp 48 and is directed to the insert 38 and therealong until it encounters the abutment 42. Now, the trailing portion of the sheet paper is being fed between the drum 30 and guide 50 and, as it can not move the folded portion thereof any further along the insert 38, it proceeds to buckle and fold between the drum 30 and the land 44. Then, the whole sheet paper, now twice folded, is rotatably discharged through the slot 28. This yields up an in-folded product, i.e., one in which the leading end of the sheet paper is folded into, or confined within, the second fold of the sheet paper.

The embodiment 10*a* of the folder shown in FIGS. 5 through 8, as priorly noted, is configured to execute a Z-fold in the sheet paper (or, optionally, an in-folded sheet of paper).

Index numbers on FIGS. 5 through 8, which are the same or similar to those employed in FIGS. 1 through 4, denote same or similar components as those so-indexed on FIGS. 1 through 4.

Folder 10*a* has a same drum 30, and an arcuate guide 50*a*, herein however, the top 24*a* has a channel 52 formed therein which opens into the housing 12*a*. The innermost end of the channel 52 defines a first abutment 54. Insert 38*a* has a termination extending inwardly of the housing which defines a second abutment 56. These two abutments, 54 and 56 are so positioned as to insure that the sheet paper fed into the housing 12*a* will be formed into a Z-fold. In operation, the sheet paper leading end is directed, by the drum 30, along the insert 40*a*, across the bottom 18, curved along the insert 38*a* and into the channel 52. Next, the sheet paper buckles, below and between the drum 30 and the guide 50*a*, and moves upwardly, therebetween. This causes the first fold to be formed, and concomitantly draws the leading end of the sheet paper from the channel 52. Now, the nose of this first fold "F" is directed by the ramp 48*a* to the second abutment 56 (as shown in FIG. 6). Again, as the sheet paper can be fed inwardly of the housing no further, it buckles again, in a free space above the near mating of the drum 30 and guide 50*a*, and is drum-driven outwardly through the slot 28. As the sheet paper is conveyed toward slot 28 , it passes between the land 44 and the drum 30, and is given its second fold.

Folder 10*a* has a third abutment 58. It is slidably confined within a trackway 60 formed whereat ,the bottom 18 and side 20 juncture. To configure folder 10*a* so that it will effect an in-folding of sheet paper, rather than a Z-fold, the third abutment 58 is extended, from the trackway 60 until it protrudes into the interior of the housing 12*a*. With reference to FIGS. 7 and 8, it will be appreciated that, in this configuration, the sheet paper will be halted, upon its entry into the housing 12*a*, at abutment 58. Then, it will be drawn up between the drum 30 and the guide 50*a*, to form the first fold "F", and conveyed to the abutment 56. Thereafter, the trailing end of the paper buckles in the free space above the near mating of the drum 30 and guide 50*a* and is directed toward the slot 28. On passing between the land 44 and the drum 30, it receives its second fold. This yields up an in-folded sheet of paper.

Folder 10*a*, then, has an especial novelty and utility, in that the retraction or extension of the abutment 58 will offer a Z-folding of the sheet paper, or an in-folding thereof.

While I have described my invention in connection with specific embodiments of the invention, it is to be clearly understood that this is done only by way of example, and not as a limitation to the scope of the invention, as set forth in the objects thereof and in the appended claims. The folders 10 and 10*a* can be so arranged that they are at halt until sheet paper is inserted thereinto via the trackway 51, and confined circuitry will then power the motor 32 to cause the folder to proceed to function. Sensors would detect the leading end of the inserted paper and signal the circuitry accordingly, and discern the exit of a folded sheet of paper through the slot 28 to turn off the motor-enabling circuitry. The drum 30 can be ribbed on the periphery, or bear a rubberized cover, to effect the conveying of the sheet paper. The guides 50 and 50*a* comprise smooth surfaces, to insure that the sheet paper slides therealong, and so too for the inwardly exposed surfaces of the inserts 40 and 40*a*, 38 and 38*a*, land 44, and ramps 48 and 48*a*. Any suitable means can be employed to insure that these surfaces will cause the sheet paper to slide freely therealong.

I claim:

1. A folder for sheet paper such as letters and fliers, comprising:

a housing;

only one, rotatable, sheet-engaging element journalled in said housing for moving the sheet paper in the housing;

means confined within said housing for driving said element in rotation;

a guide, mounted within said housing in juxtaposition with said element for guiding the sheet paper between the guide and the sheet engaging element in order to fold the sheet paper;

first access means for admitting sheet paper into said housing;

second access means for discharging folded sheet paper from said housing; and first and second abutment means, within said housing, said first abutment means for engagement thereof by a leading end of the sheet paper and said second abutment means for engagement thereof by a first fold of the sheet paper.

2. A folder, according to claim 1, further including:

ramp means, in adjacency to said first abutment means, for directing the sheet paper away from said element.

3. A folder, according to claim 1, wherein: said guide is of arcuate conformation.

4. A folder, according to claim 1, further including: means coupled to said housing, in alignment with said first access means, for (a) slidably receiving the sheet paper thereon, and (b) feeding the sheet paper to said first access means.

5. A folder, according to claim 1, wherein:

said housing has an imperforate bottom, imperforate end walls, a top, and parallel sides;

said first access means comprises a slot formed in said top; and said second access means comprises slot formed in one of said sides.

6. A folder, according to claim 5, further including:

ramp means, coupled to said top and extending inwardly of said housing, for directing the sheet paper away from said element.

7. A folder, according to claim 1, wherein:

said element comprises a cylindrical drum.

8. A folder, for sheet paper such as letter-mail, and fliers, comprising:

a housing;

only one, rotatable, sheet-engaging element journalled in said housing;

means confined within said housing for driving said element in rotation;

a guide, mounted within said housing in juxtaposition with said element;

first access means for admitting sheet paper into said housing;

second access means for discharging folded sheet paper from said housing; and abutment means, within said housing, for (a) engagement thereof by a leading end of the sheet paper, and (b) engagement thereof by a first fold of the sheet paper; wherein said housing has an imperforate bottom, imperforate end walls, a top and parallel sides;

said first access means comprises a slot formed in said top; and said second access means comprises a slot formed in one of said sides; and said abutment means comprises a first abutment projecting from said top, inwardly of said housing, and a second abutment projecting from said bottom, inwardly of said housing.

9. A folder, according to claim 8, further including:

ramp means, in adjacency to said first abutment, for directing the sheet paper away from said element.

10. A folder, for sheet paper such as letter-mail, and fliers, comprising:

a housing;

only one, rotatable, sheet-engaging element journalled in said housing;

means confined within said housing for driving said element in rotation;

a guide, mounted within said housing in juxtaposition with said element;

first access means for admitting sheet paper into said housing;

second access means for discharging folded sheet paper said housing; and abutment means, within said housing, for (a) engagement thereof by a leading end of the sheet paper, and (b) engagement thereof by a first fold of the sheet paper; wherein said housing has an imperforate bottom, imperforate end walls, a top and parallel sides;

said first access means comprises a slot formed in said top; and said second access means comprises a slot formed in one of said sides; and said abutment means comprises a first abutment projecting from said top, inwardly of said housing, and a second abutment projecting inwardly of said housing from said bottom, both of said abutments occupying a substantially common plane.

11. A folder, for sheet paper such as letter-mail, and fliers, comprising:

a housing;

only one, rotatable, sheet-engaging element journalled in said housing;

means confined within said housing for driving said element in rotation;

a guide, mounted within said housing in juxtaposition with said element;

first access means for admitting sheet paper into said housing;

second access means for discharging folded sheet paper from said housing; and abutment means, within said housing, for (a) engagement thereof by a leading end of the sheet paper, and (b) engagement thereof by a first fold of the sheet paper; wherein said housing has an imperforate bottom, imperforate end walls, a top and parallel sides;

said first access means comprises a slot formed in said top; and said second access means comprises a slot formed in one of said sides; and said abutment means comprises a first abutment projecting from said top, inwardly of said housing, and a second abutment extending inwardly of said housing from approximately whereat said bottom and one of said sides juncture.

12. A folder, according to claim 11, wherein:

said second abutment is slidably engaged with a trackway formed at said juncture, and is retractable, within said trackway, for preventing an engagement of the sheet paper therewith.

13. A folder, for sheet paper such as letter-mail, and fliers, comprising:

a housing;

only one, rotatable, sheet-engaging element journalled in said housing;

means confined within said housing for driving said element in rotation;

a guide, mounted within said housing in juxtaposition with said element;

first access means for admitting sheet paper into said housing;

second access means for discharging folded sheet paper from said housing; and abutment means, within said housing, for (a) engagement thereof by a leading end of the sheet paper, and (b) engagement thereof by a first fold of the sheet paper; wherein said housing has an imperforate bottom, imperforate end walls, a top, and parallel sides;

said first access means comprises a slot formed in said top; and said second access means comprises a slot formed in one of said sides; and said top has a channel formed therein which opens into said housing.

14. A folder, according to claim 13, wherein:

said channel has an termination which defines an abutment.

* * * * *